US007609247B2

(12) United States Patent
Fujita

(10) Patent No.: US 7,609,247 B2
(45) Date of Patent: Oct. 27, 2009

(54) DRIVING CIRCUIT FOR LIQUID CRYSTAL DISPLAY DEVICE, LIQUID CRYSTAL DISPLAY DEVICE, METHOD OF DRIVING LIQUID CRYSTAL DISPLAY DEVICE, AND ELECTRONIC APPARATUS

(75) Inventor: Shin Fujita, Suwa (JP)

(73) Assignee: Epson Imaging Devices Corporation (JP)

( * ) Notice: Subject to any disclaimer, the term of this patent is extended or adjusted under 35 U.S.C. 154(b) by 588 days.

(21) Appl. No.: 11/399,673

(22) Filed: Apr. 6, 2006

(65) Prior Publication Data

US 2006/0227096 A1 Oct. 12, 2006

(30) Foreign Application Priority Data

Apr. 7, 2005 (JP) ..... 2005-110554
Mar. 14, 2006 (JP) ..... 2006-068765

(51) Int. Cl.
*G09G 3/36* (2006.01)
*G09G 5/00* (2006.01)

(52) U.S. Cl. ..... 345/96; 345/209; 345/100

(58) Field of Classification Search ..... 345/96, 345/208–211
See application file for complete search history.

(56) References Cited

U.S. PATENT DOCUMENTS

2002/0084969 A1* 7/2002 Ozawa ..... 345/96
2003/0090450 A1* 5/2003 Inada et al. ..... 345/87

FOREIGN PATENT DOCUMENTS

JP 2001-255851 A 9/2001
JP 2002-196358 7/2002
JP 2002-229519 8/2002

* cited by examiner

*Primary Examiner*—Amr Awad
*Assistant Examiner*—Jonathan Boyd
(74) *Attorney, Agent, or Firm*—Harness, Dickey & Pierce, P.L.C.

(57) ABSTRACT

A driving circuit includes a scanning-line driving circuit applying an on potential to sequentially drive scanning-lines, a data-line driving circuit that, when the on potential is applied to each scanning-line, turns each data-line potential to a potential difference corresponding to a density based on a counter electrode potential and a potential corresponding to the same writing polarity among the scanning-lines, and a storage capacitor driving circuit which, when the on potential is applied to the scanning-lines and the data-line potential corresponds to positive polarity writing, shifts the other storage capacitor electrode potential in each storage capacitor to a high level after an off potential is applied to the scanning-lines, and, when the on potential is applied to the scanning-lines and the data-line potential corresponds to negative polarity writing, shifts the other storage capacitor electrode potential to a low level after the off potential is applied to the scanning-lines.

6 Claims, 11 Drawing Sheets

DRIVING CIRCUIT FOR LIQUID CRYSTAL DISPLAY DEVICE, LIQUID CRYSTAL DISPLAY DEVICE, METHOD OF DRIVING LIQUID CRYSTAL DISPLAY DEVICE, AND ELECTRONIC APPARATUS

BACKGROUND

1. Technical Field

The present invention relates to a driving circuit for a liquid crystal display device which realizes low power consumption, a liquid crystal display device, a method of driving a liquid crystal display device, and an electronic apparatus.

2. Related Art

In recent years, liquid crystal display devices are widely used for electronic apparatuses, such as various information processing apparatus or flat screen televisions, as display device to replace cathode ray tubes (CRTs). The liquid crystal display devices are classified into various types according to driving methods or the like. For example, an active-matrix-type liquid crystal display device in which pixels are driven by switching elements has the following configuration. Specifically, the active-matrix-type liquid crystal display device has an element substrate on which pixel electrodes arranged in a matrix shape or switching elements correspondingly connected to the pixel electrodes are provided, a counter substrate on which a counter electrode is formed to face the pixel electrodes, and liquid crystal interposed between both substrates.

According to this configuration, if an on potential is applied to a scanning line, switching elements connected to the scanning line become conductive. In the conductive state, if a voltage signal corresponding to a gray-scale level (density) is applied to a pixel electrode through a data line, a charge corresponding to the voltage signal is stored in a liquid crystal capacitor in which liquid crystal is interposed between the pixel electrode and the counter electrode. After the charge is stored, even if an off potential is applied to the scanning line to make the switching element nonconductive, the charge stored in liquid crystal is held by capacitance of the liquid crystal capacitor itself or a storage capacitor provided in parallel with the liquid crystal capacitor. In such a manner, by driving each switching element and controlling the amount of charge to be stored according to the gray-scale level, the alignment state of liquid crystal changes. Therefore, the density changes for each pixel, thereby making it possible to perform gray-scale display.

In the liquid crystal display device, in view of characteristics, features, and uses of an electronic apparatus to which the liquid crystal display device is applied, low power consumption is strongly demanded. On the other hand, in a liquid crystal display device, data lines are driven at a high frequency, and a high swing voltage of 10 volts or more is required for driving a liquid crystal capacitor. Accordingly, a high swing voltage is generally applied to the data lines.

There is suggested a liquid crystal display device which reduces a swing voltage of a voltage signal applied to data lines, thereby realizing low power consumption (for example, see JP-A-2002-196358).

However, according to the configuration disclosed in JP-A-2002-196358, the swing voltage is reduced, but there is no change in frequency at which the data lines are driven. Accordingly, a reduction in power consumption is further demanded.

SUMMARY

An advantage of some aspects of the invention is that it provides a driving circuit for a liquid crystal display device which realizes low power consumption, a liquid crystal display device, a method of driving a liquid crystal display device, and an electronic apparatus.

According to a first aspect of the invention, there is provided a driving circuit for a liquid crystal display device, which has adjacent scanning line groups each having a plurality of scanning lines, data lines, liquid crystal capacitors correspondingly provided intersections between the plurality of scanning lines and the data lines with liquid crystal interposed between a counter electrode and pixel electrodes, switching elements interposed between the data lines and the pixel electrodes, the switching elements being turned on when an on potential is applied to the scanning lines and being turned off when an off potential is applied to the scanning lines, and storage capacitors each having one storage capacitor electrode connected to the corresponding pixel electrode and the other storage capacitor electrode disposed to face one storage capacitor electrode. The driving circuit for a liquid crystal display device includes a scanning line driving circuit that applies the on potential to the plurality of scanning lines so as to sequentially drive the plurality of scanning lines, a data line driving circuit that, when the on potential is applied to each of the plurality of scanning lines by the scanning line driving circuit, turns the potentials of the data lines to a potential difference according to a density on the basis of a potential of the counter electrode and the potentials corresponding to the same writing polarity among the scanning lines belonging to each of the scanning line groups, and a storage capacitor driving circuit which, when the on potential is applied to the scanning lines and the potential of the data line corresponds to positive polarity writing, shifts a potential of the other storage capacitor electrode in each of the storage capacitors to a high level after the off potential is applied to the scanning lines, and, when the on potential is applied to the scanning lines and the potential of the data line corresponds to negative polarity writing, shifts the potential of the other storage capacitor electrode in each of the storage capacitors to a low level after the off potential is applied to the scanning lines.

According to this configuration, the potential supplied from the data line to the liquid crystal capacitor and one storage capacitor electrode of the storage capacitor is increased (or decreased) according to the shift amount of the other storage capacitor electrode, and the data line is driven at a low voltage. Further, when the potential is supplied to the data line corresponding to the scanning line to which the on potential is applied, the data line driving circuit turns the same writing polarity to the scanning line group having a plurality of adjacent scanning lines. For this reason, for the plurality of adjacent scanning lines, the potential for driving the data lines is not polarity-inverted. Therefore, the data lines are driven at a low voltage, thereby realizing low power consumption. Further, a frequency at which the data lines are inversely driven is reduced, thereby realizing lower power consumption.

Here, in the driving circuit for a liquid crystal display device according to the first aspect of the invention, it is preferable that the storage capacitor driving circuit perform the potential shift corresponding to the plurality of scanning lines belonging to each of the scanning line groups simultaneously.

According to, this configuration, the potential shift of the other storage capacitor electrode by the storage capacitor driving circuit is performed at the same timing to the scanning lines belonging to the scanning line group. By making the timing, as well as the writing polarity of the potential shift, the same, one storage capacitor driving circuit can be shared by a plurality of scanning lines belonging to one scanning line group. Therefore, the driving circuit can be reduced in size or integrated.

Here, in the driving circuit for a liquid crystal display device according to the first aspect of the invention, it is preferable that the number of adjacent scanning lines belonging to each of the scanning line groups be two, and the data line driving circuit invert the writing polarities of the data lines for every two horizontal scanning periods.

According to this configuration, the frequency at which the data lines are inversely driven can be lowered by about half, as compared with inversion driving for every one horizontal scanning period. Therefore, low power consumption can be further realized.

Here, in the driving circuit for a liquid crystal display device according to the first aspect of the invention, it is preferable that the data line driving circuit turn the potentials of the data lines to the potentials corresponding to different writing polarities between adjacent scanning line groups.

In the liquid crystal display device, a variation in potential of the pixel electrode for each data line is caused by manufacturing ununiformity or the like, which causes vertical stripe-shaped noise to be displayed on a screen. According to the above-described configuration, the writing polarity of the potential is inverted between adjacent scanning line groups, and thus the potential of the pixel electrode is polarity-inverted for each scanning line group. Therefore, a change in display luminance due to the variation in potential can be removed and reduced by an adjacent scanning line group.

Further, according to a second aspect of the invention, a liquid crystal display device includes the driving circuit for a liquid crystal display device described above. Therefore, the data line is driven at a low voltage, thereby realizing low power consumption. In addition, according to a third aspect of the invention, an electronic apparatus includes the liquid crystal display device described above. Therefore, low power consumption can be realized.

Further, according to a fourth aspect of the invention, there is provided a method of driving a liquid crystal display device, which has adjacent scanning line groups each having a plurality of scanning lines, data lines, liquid crystal capacitors correspondingly provided intersections between the plurality of scanning lines and the data lines with liquid crystal interposed between a counter electrode and pixel electrodes, switching elements interposed between the data lines and the pixel electrodes, the switching elements being turned on when an on potential is applied to the scanning lines and being turned off when an off potential is applied to the scanning lines, and storage capacitors each having one storage capacitor electrode connected to the corresponding pixel electrode and the other storage capacitor electrode disposed to face one storage capacitor electrode. The method of driving a liquid crystal display device includes sequentially applying the on potential to the plurality of scanning lines, when the on potential is applied to each of the plurality of scanning lines, turning the potentials of the data lines to a potential difference according to a density on the basis of a potential of the counter electrode and the potentials corresponding to the same writing polarity among the scanning lines belonging to each of the scanning line groups, and, when the on potential is applied to the scanning lines and the potential of the data line corresponds to positive polarity writing, shifting a potential of the other storage capacitor electrode in each of the storage capacitors to a high level after the off potential is applied to the scanning lines, and, when the on potential is applied to the scanning lines and the potential of the data line corresponds to negative polarity writing, shifting the potential of the other storage capacitor electrode in each of the storage capacitors to a low level after the off potential is applied to the scanning lines.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings.

1: First Embodiment

Figure 1:
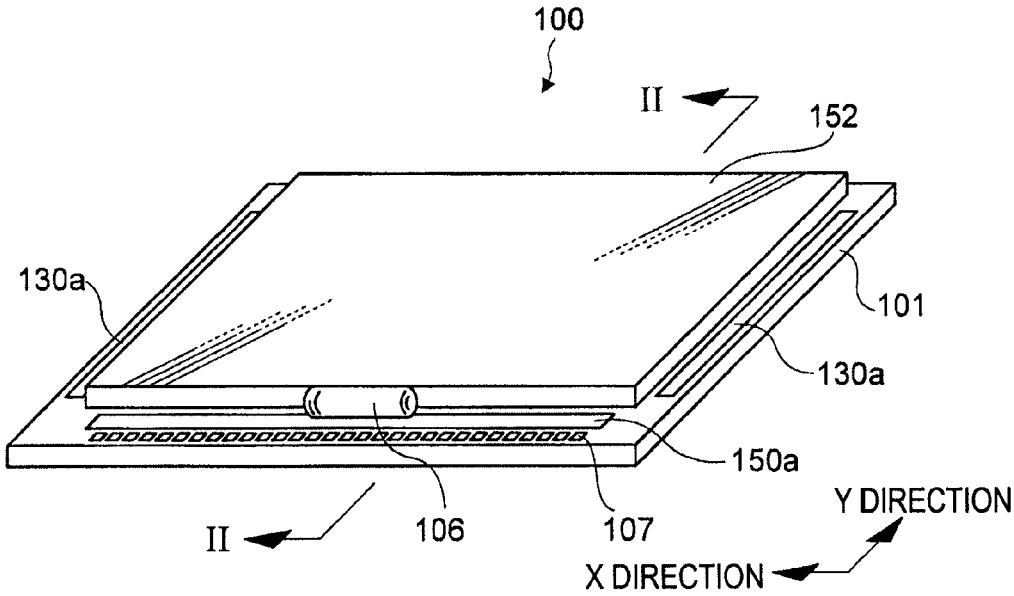
FIG. 1 is a perspective view showing an exterior configuration of a liquid crystal display device according to a first embodiment of the invention.
Figure 2:
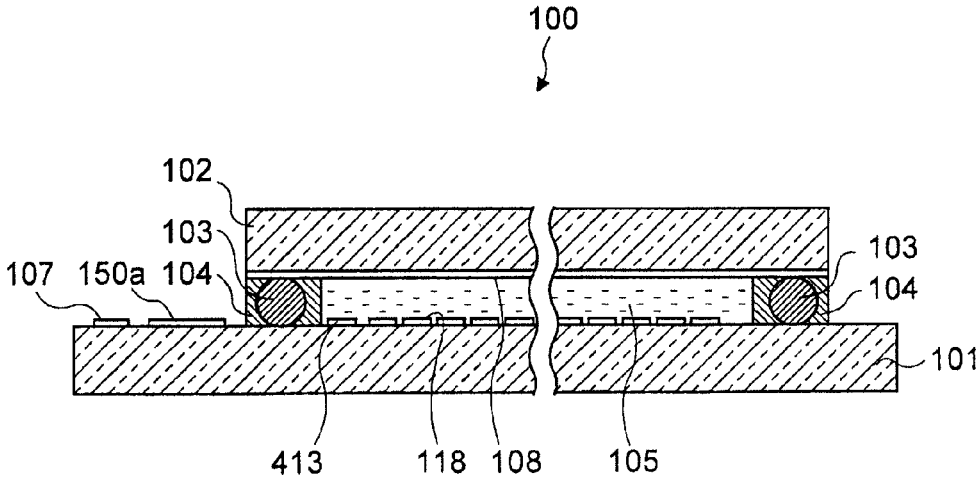
FIG. 2 is a cross-sectional view taken along the line II-II of FIG. 1.

First, a liquid crystal display device according to a first embodiment of the invention will be described. FIG. 1 is a perspective view showing the exterior configuration of the liquid crystal display device. FIG. 2 is a cross-sectional view taken along the line II-II of FIG. 1. As shown in FIGS. 1 and 2, a liquid crystal display device 100 has an element substrate 101 on which various elements and pixel electrodes 118 are formed, and a counter substrate 102 on which a counter electrode 108 and the like are formed. The element substrate 101 and the counter substrate 102 are bonded together at a predetermined gap by a sealant 104 containing spacers 103 such that the surfaces with the electrodes formed thereon face each other. In the gap, liquid crystal 105 of a TN (Twisted Nematic) mode, a vertical alignment mode, or a transverse electric field mode is filled.

Moreover, in this embodiment, for the element substrate 101, glass, semiconductor, or quartz is used, but a nontransparent substrate may be used. However, when the nontransparent substrate is used for the element substrate 101, the display device needs to be of a reflection type, not a transmission type. Further, the sealant 104 is formed along the periphery of the counter substrate 102, and has an opening to fill liquid crystal 105. For this reason, after liquid crystal 105 is filled, the opening is sealed by a sealing material 106.

Next, on an opposing surface of the element substrate 101, in a region 150*a* located along an outer edge of the sealant 104, a circuit for driving the data lines is formed (the details will be described below). In addition, at the outer edge, a plurality of package terminals 107 are formed to which various signals are input from external circuits. Moreover, the circuit for driving the data lines is disposed outside the sealant 104, but may be disposed in the region where the sealant 104 is formed.

Further, in a region 130*a* adjacent to this edge, circuits that drive scanning lines and capacitor lines are formed (the details will be described below) to drive from both sides in a row (X) direction. Further, at the remaining edge, wiring lines (not shown), which are shared by the circuits formed in the two regions 130*a*, are provided. Moreover, if the delay of the signals supplied in the row direction is not a problem, the circuit which outputs the signals may be formed in only one region 130*a*. The circuits that drive the scanning lines and the capacitor lines may be disposed outside the sealant 104 or in the region where the sealant 104 is formed.

On the other hand, the counter electrode 108 provided on the counter substrate 102 is electrically connected to the package terminal 107 formed on the element substrate 101 by a conductive material, such as silver paste or the like, provided in at least one place from the four corners of parts laminated with the element substrate 101, and is formed to maintain a common potential LCcom as an opposing potential of the pixel electrode 118. In addition, though not particularly shown, on the counter substrate 102, a colored layer (color filter) is provided in a region facing the pixel electrodes 118 as necessary. However, like a projector described below, for the use of color light modulation, it is not necessary to form a colored layer on the counter substrate 102. Further, regardless whether or not the colored layer is provided, in order to prevent deterioration of the contrast ratio caused by light leakage, a light-shielding film is provided in a portion other than the region facing the pixel electrodes 118 (not shown).

Further, on each of opposing surfaces of the element substrate 101 and the counter substrate 102, an alignment film processed by rubbing is provided in such a manner that, in case of the TN mode, the longitudinal directions of molecules in liquid crystal 105 are consecutively twisted at about 90 degrees between both substrates. On the other hand, on each of the back sides, a polarizer is provided such that the absorption axis is along the alignment direction. Accordingly, if the value of an effective voltage applied to a liquid crystal capacitor (a capacitor between the pixel electrode 118 and the counter electrode 108 with liquid crystal 105 interposed therebetween) is zero, the maximum transmittance is obtained. As the value of the effective voltage increases, the transmittance gradually decreases and reaches the minimum. That is, in this embodiment, the liquid crystal display device is formed in a normally white mode.

Moreover, the alignment film and the polarizer do not directly relate to the invention, and thus are not shown in the drawings. Further, in FIG. 2, the counter electrode 108, the pixel electrodes 118, and the package terminals 107 have a thickness, but this is for the sake of convenience, and in practice they are so thin as to be invisible with respect to the thickness of the substrate.

1-1: Electrical Configuration

Figure 3:
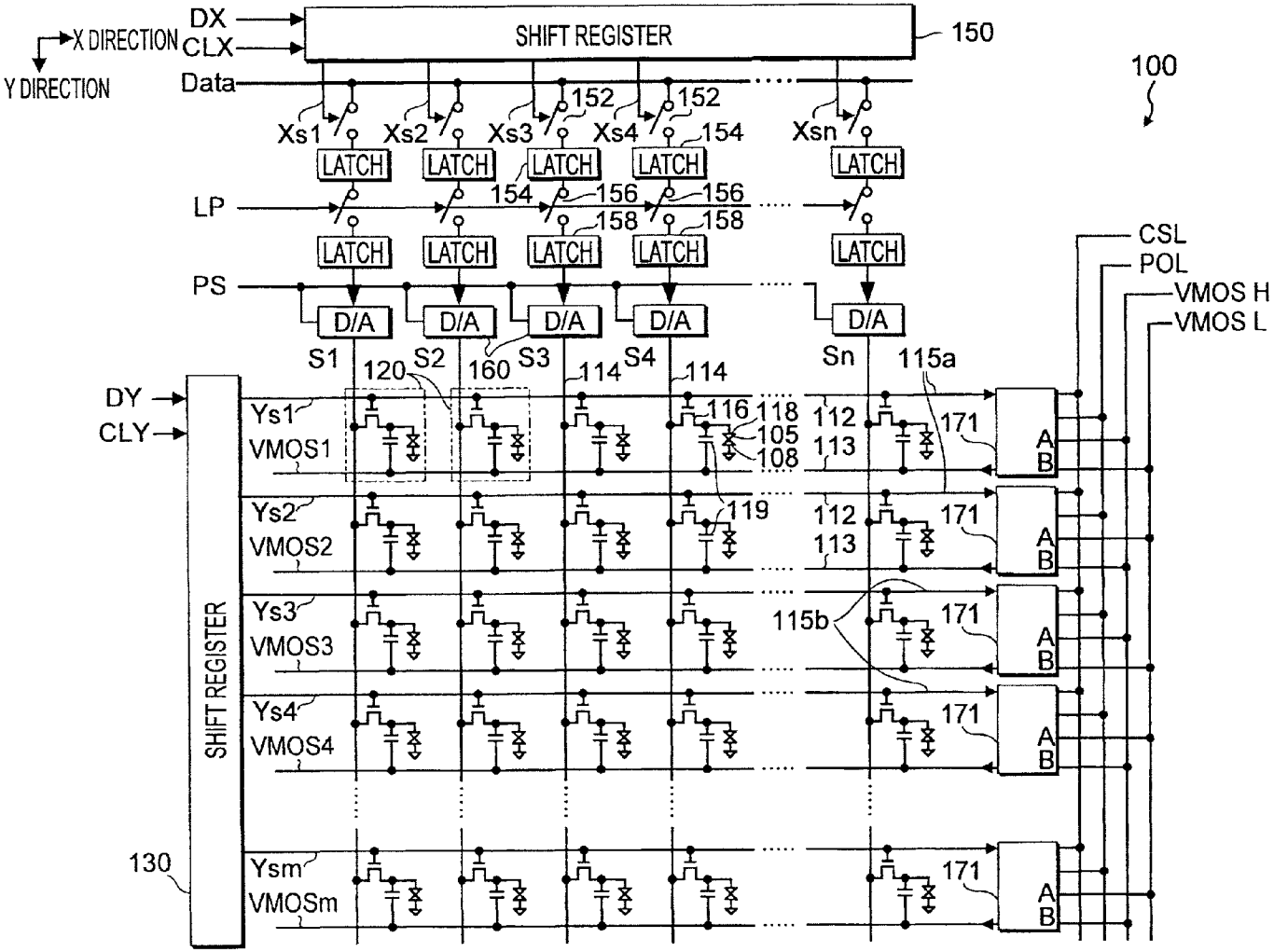
FIG. 3 is a block diagram showing an electrical configuration of the liquid crystal display device.

Next, the electrical configuration of the liquid crystal display device 100 according to this embodiment will be described. FIG. 3 is a block diagram showing the electrical configuration. As shown in FIG. 3, a plurality of scanning lines 112 and capacitor lines 113, each of which constitutes the other storage capacitor electrode of a storage capacitor are formed to extend in an X (row) direction, and data lines 114 are formed to extend in a Y (column) direction. Pixels 120 are correspondingly formed at intersections between the scanning lines 112 and the data lines 114. The scanning lines 112 are divided into scanning line groups 115*a*, 115*b* . . . (115) each having two adjacent scanning lines 112. The scanning line group 115*a* has two scanning lines 112 of the first row and second row, and the scanning line group 115*b* has two scanning lines 112 of the third row and fourth row. Here, for convenience of explanation, if the number of scanning lines 112 (capacitor lines 113) is 'm', and the number of data lines 114 is 'n', the pixels 120 are arranged in a matrix-shape with m rows and n columns. Further, in this embodiment, m and n are shown as even numbers in the drawing, but, this is not intended to limit the invention.

Here, when paying attention to one pixel 120, the gate of an N-channel thin film transistor (hereinafter, referred to as 'TFT') 116 is connected to the scanning line 112, the source thereof is connected to the data line 114, and the drain thereof is connected to the pixel electrode 118 and one capacitor electrode which constitutes a storage capacitor 119 and to which a pixel potential is applied. As described above, the pixel electrode 118 faces the counter electrode 108, and liquid crystal 105 is sandwiched therebetween, thereby forming the liquid crystal capacitor. That is, the liquid crystal capacitor is formed by sandwiching liquid crystal 105 with one end thereof formed as the pixel electrode 118 and the other end as the counter electrode 108. With this configuration, when a scanning signal supplied to the scanning line 112 is an on potential, that is, in the H level, the TFT 116 is turned on, and a charge corresponding to a potential of the data line 114 is written to the liquid crystal capacitor and the storage capacitor 119. Moreover, in this embodiment, the other capacitor electrode constituting the storage capacitor 119 is connected to the capacitor lines 113 in common for every row.

Figure 4:
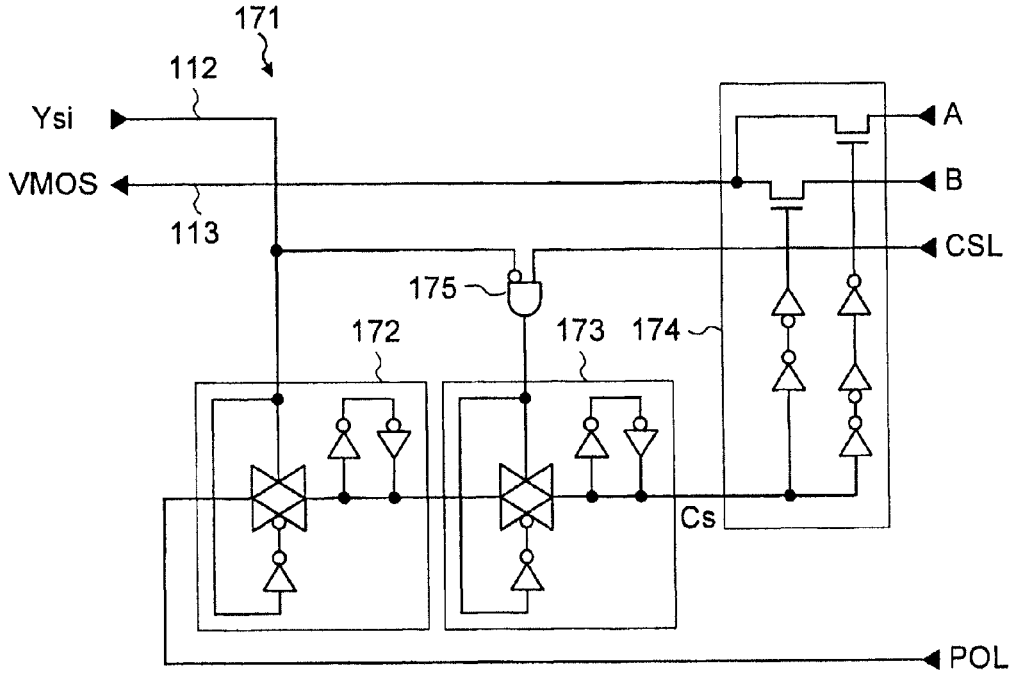
FIG. 4 is a circuit diagram showing an electrical configuration of a capacitor line driving circuit of the liquid crystal display device.
Figure 5:
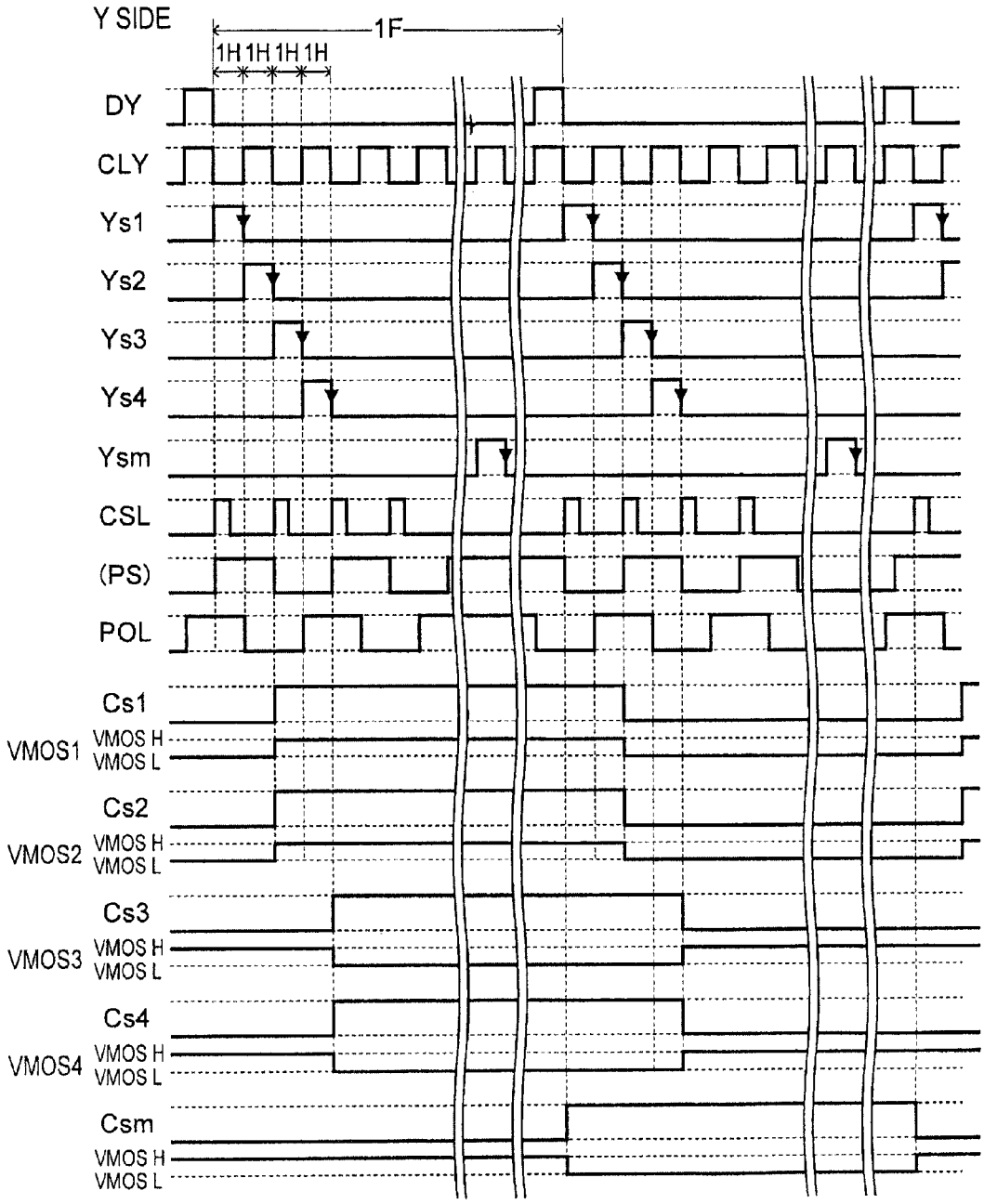
FIG. 5 is a timing chart illustrating a Y side operation in the liquid crystal display device.

Now, when paying attention to a Y side, as shown in FIG. 4, a shift register 130 (scanning line driving circuit) sequentially shifts a transmission start pulse DY supplied at the beginning of one vertical scanning period (1F) at rise and fall of a clock signal CLY so as to supply scanning signals Ys1, Ys2, Ys3, . . . , and Ysm to the scanning lines 112 of the first, second, third, . . . , and the m-th row, respectively. Here, as shown in FIG. 5, the scanning signals Ys1, Ys2, Ys3, . . . , and Ysm becomes the active level (H level) for every one horizontal scanning period (1H) so as not to overlap one another. In such a manner, the shift register 130 applies the on potential to the individual scanning lines 112 so as to sequentially drive the scanning lines 112.

In the liquid crystal display device 100, a capacitor line driving circuit 171 (storage capacitor driving circuit) is further provided for every row. In general, the scanning signal Ysi corresponding to the i-th (where i is an integer satisfying $1 \leqq i \leqq m$) row is supplied to the capacitor line driving circuit 171 corresponding to the same i-th row. Further, a capacitor control signal CSL for controlling output timing, and a polarity control signal POL (see FIG. 5) whose logic level is inverted for every two horizontal scanning periods (2H) are also supplied to the capacitor line driving circuit 171. Here, the capacitor control signal CSL has one H-level pulse for every two horizontal scanning periods (2H).

The capacitor line driving circuit 171 holds the logic level of the polarity control signal POL when the logic level of the scanning signal Ysi is in the H level. The capacitor line driving circuit 171 selects an input terminal A if the held logic level is in the H level or selects an input terminal B if the held logic level is in the L level so as to generate a capacitor swing signal VMOSi, and supplies the capacitor swing signal VMOSi to the capacitor line 113 of the i-th row at the timing when the capacitor control signal CSL becomes the H level.

FIG. 4 is a circuit diagram showing the electrical configuration of the capacitor line driving circuit 171. The capacitor line driving circuit 171 has a latch 172 which holds the logic level of the polarity control signal POL when the logic level of the scanning signal Ysi is in the H level, a latch 173 which outputs the level held by the latch 172 as a selection control signal Cs at the timing when the capacitor control signal CSL becomes the H level, a selector 174 which selects one of the potential of the input terminal A or the potential of the input terminal B according to the level of the selection control signal Cs and supplies the selected signal to the capacitor line 113 as the capacitor swing signal VMOS, and a NOR gate circuit 175 which supplies an inverted signal of a logical sum of the inverted signal of the capacitor control signal CSL and the scanning signal Ysi to the latch 173. When the scanning signal Ysi is in the H level, with the output signal of the NOR gate circuit 175, the latch 173 does not output the level held by the latch 172 even though the capacitor signal CSL becomes the H level.

Moreover, if the capacitor control signal CSL of the H level is supplied when the scanning signal Ysi is not in the H level, the capacitor control signal CSL may be directly to the latch 173, without using the NOR gate circuit 175. However, by using the NOR gate circuit 175, even though the scanning signal Ysi is in the H level, the scanning signal Ysi can become the H level.

Here, returning to FIG. 3, the potential of the input terminal A in the capacitor line driving circuit 171 of the odd-numbered row is a high capacitor potential VMOSH, and the potential of the input terminal B is a low capacitor potential VMOSL. On the other hand, the potential of the input terminal A in the capacitor line driving circuit 171 of the even-numbered row is the low capacitor potential VMOSL, and the potential of the input terminal B is the high capacitor potential VMOSH. That is, in the capacitor line driving circuit 171 of the odd-numbered row and the capacitor line driving circuit 171 of the even-numbered row, the capacitor potentials of the input terminals A and B are replaced with each other for every row. Here, the polarity control signal POL for selecting the potential of the input terminal A or the input terminal B has the logic level which is inverted for every two horizontal scanning periods (2H) (see FIG. 5), and the replacement is cancelled between the scanning lines corresponding to the selection inversion. Accordingly, the capacitor potential is replaced and output from the capacitor line driving circuit 171 to correspond to the scanning line group 115*a*, 115*b* . . . .

Figure 6:
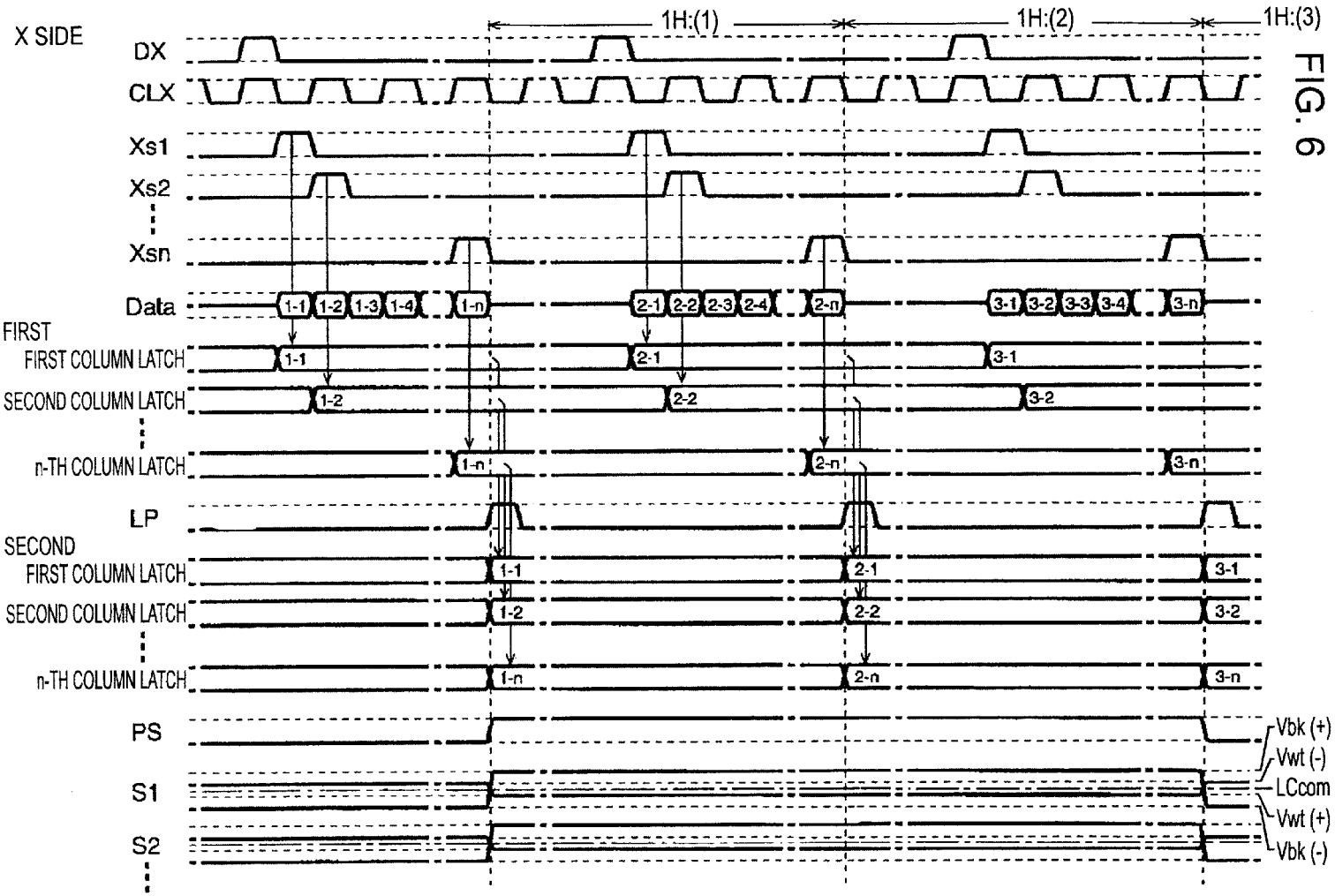
FIG. 6 is a timing chart illustrating an X side operation in the liquid crystal display device.

Next, when paying attention to an X side, as shown in FIG. 6, a shift register 150 sequentially shifts a transmission start pulse DX at rise and fall of a clock signal CLX and outputs sampling control signal Xs1, Xs2, and Xsn which exclusively become the active level (H level). Here, the sampling control signal Xs1, Xs2, . . . , and Xsn sequentially become the active level (H level) so as not to overlap one another.

Now, on the output side of the shift register 150, a first sampling switch 152, a first latch circuit 154, a second sampling switch 156, a second latch circuit 158, and a D/A converter 160 are provided for each column of the data line 114. Among these, in general, the first sampling switch 152 corresponding to the j-th column (j is an integer satisfying $1 \leqq j \leqq n$) is turned on when the sampling control signal Xsj becomes the active level, and samples gray-scale data Data.

Here, gray-scale data Data is 4-bit digital data specifying the gray-scale level (density) of the pixel 120. For this reason, in the liquid crystal display device according to this embodiment, the pixel 120 displays 16 ($=2^4$) gray-scale levels according to 4-bit gray-scale data Data. Moreover, gray-scale data Data is supplied from an external circuit (not shown) through the package terminals 107 (see FIG. 1) at a predetermined timing.

The first latch circuit 154 corresponding to the j-th column latches gray-scale data Data sampled by the first sampling switch 152 corresponding to the same j-th column. Next, the second sampling switch 156 corresponding to the j-th column samples gray-scale data Data latched by the first latch circuit 154 corresponding to the same j-th column when a latch pulse LP becomes the active level (H level). In addition, the second latch circuit 158 corresponding to the j-th column latches gray-scale data Data sampled by the second sampling switch 156 corresponding to the same j-th column.

The D/A converter 160 of the j-th column converts gray-scale data Data latched by the second latch circuit 158 corresponding to the same j-th column into an analog signal having a polarity corresponding to the logic level of a polarity writing instruction signal PS, and outputs the analog signal as a data signal Sj so as to turn the potential of the data line to a potential difference according to the gray-scale level. Here, the polarity writing instruction signal PS whose logic level is in the H level instructs positive polarity writing into the pixel 120, and the polarity writing instruction signal PS whose logic signal is in the L level instructs negative polarity writing into the pixel 120. In this embodiment, as shown in FIG. 6, the polarity writing instruction signal PS is delayed by one horizontal scanning period (lH) with respect to the polarity control signal POL, and the logic level thereof is inverted for every two horizontal scanning periods (2H) to correspond to the scanning line groups 115*a*, 115*b* . . . (2H inversion driving). For this reason, the potentials of the data lines 114 correspond to the same writing polarity among the scanning lines belonging to each of the scanning ling groups 115*a*, 115*b* . . . , and correspond to different writing polarities between adjacent scanning line groups. Further, the logic level of the polarity writing instruction signal PS is also inverted for every one vertical scanning period within the same horizontal scanning period (see the signal in parenthesis of FIG. 5).

Moreover, the shift register 150, the sampling switches 152 and 156, the latch circuits 154 and 158, and the D/A converter 160 correspond to a data line driving circuit of the invention. Further, in addition to the data line driving circuit, the shift register 130 and the capacitor line driving circuit 171 serving as the storage capacitor driving capacitor correspond to a driving circuit for a liquid crystal display device of the invention.

In this embodiment, the transmission start pulses DX and DY, the clock signals CLX and CLY, the latch pulse LP, the polarity writing instruction signal PS, the capacitor control signal CSL, the polarity control signal POL, and the capacitor potentials VMOSH and VMOSL are supplied from the external circuit (not shown) through the package terminals 107 at the predetermined timing. Alternatively, however, a signal generating circuit which outputs all or some of the signals may be provided in the liquid crystal display device.

Further, in this embodiment, the polarity inversion in the pixel 120 or the liquid crystal capacitor means that the voltage level applied to the pixel electrode 118 serving as one end of the liquid crystal capacitor is alternately inverted on the basis of the potential applied to the counter electrode 108 serving as the other end of the liquid crystal capacitor. Further, in FIG. 3, the shift register 130 and the capacitor line driving circuit 171 are individually arranged on left and right sides with respect to the arrangement region of the pixels 120, but, in practice, the scanning lines and the capacitor lines may be driven from one of left and right sides.

1-2: Y Side Operation

Next, among the operations of the liquid crystal display device having the above-described configuration, the Y side operation will be described. Here, FIG. 5 is a timing chart illustrating the Y side operation in the liquid crystal display device.

As shown in FIG. 5, the transmission start pulse DY supplied at the beginning of one vertical scanning period (1F) is sequentially shifted by the shift register 130 at rise and fall of the clock signal CLY, and is output as the scanning signals Ys1, Ys2, Ys3, . . . , and Ysm which sequentially and exclusively become the H level for every one horizontal scanning period (1H).

Here, in an initial vertical scanning period (1F), when the scanning signal Ys1 becomes the H level, the polarity writing instruction signal PS becomes the H level (positive polarity writing is instructed to the pixel 120 located at the scanning line 112 of the first row). Further, the polarity control signal POL is in the H level, and the latch 172 of the capacitor line driving circuit 171 corresponding to the first row holds that logic level. After the scanning signal Ys1 falls and the TFT 116 of the pixel 120 located at the first row is turned off, if the capacitor control signal CSL becomes the H level, the held level of the polarity control signal POL is output from the latch 173 as the signal Cs1. As a result, since the capacitor line driving circuit 171 selects the potential VMOSH of the input terminal A, the capacitor swing signal VMOS1 changes to the high capacitor potential VMOSH.

Next, when the scanning signal Ys2 becomes the H level, the polarity writing instruction signal PS maintains the H level. (Positive polarity writing is instructed to the pixel 120 located at the scanning line 112 of the second row). At this time, the polarity control signal POL changes to the L level, and the latch 172 of the capacitor line driving circuit 171 corresponding to the second row holds that logic level. After the scanning signal Ys2 falls, and the TFT 116 of the pixel 120 located at the second row is turned off, if the capacitor control signal CSL becomes the H level, the held level of the polarity control signal POL is output from the latch 173 as the signal Cs2. As a result, the capacitor line driving circuit 171 selects the potential of the input terminal B. Here, since VMOSH is supplied to the input terminal B, like VMOS1, the capacitor swing signal VMOS2 also changes to the high capacitor potential VMOSH.

Here, the H level pulse of the capacitor control signal CSL is supplied for two horizontal scanning periods (2H) once, and the timing is just after the falling edge of the scanning signal Ys2, not just after the falling edge of the scanning signal Ys1. Accordingly, the capacitor line driving circuits 171 of the first row and second row change the capacitor swing signals VMOS1 and VMOS2 to the high capacitor potential VMOSH at the timing when the capacitor control signal CSL is in the H level.

Next, when the scanning signal Ys3 becomes the H level, the polarity writing instruction signal PS changes to the L level. (Negative polarity writing is instructed to the pixel 120 located at the scanning line 112 of the third row). At this time, the polarity control signal POL maintains the L level, and the-latch 172 of the capacitor line driving circuit 171 corresponding to the third row holds that logic level. After the scanning signal Ys3 falls, and the TFT 116 of the pixel 120 located at the third row is turned off, if the capacitor control signal CSL becomes the H level, the held level of the polarity control signal POL is output from the latch 173 as the signal Cs3. As a result, the capacitor line driving circuit 171 selects the potential of the input terminal B. Here, since VMOSL is supplied to the input terminal B, the capacitor swing signal VMOS3 changes to the low capacitor potential VMOSL.

Next, when the scanning signal Ys4 becomes the H level, the polarity writing instruction signal PS maintains the L level. (Negative polarity writing is instructed to the pixel 120 located at the scanning line 112 of the fourth row). At this time, the polarity control signal POL changes to the H level, and the latch 172 of the capacitor line driving circuit 171 corresponding to the fourth row holds that logic level. After the scanning signal Ys4 falls, and the TFT 116 of the pixel 120 located at the fourth row is turned off, if the capacitor control signal CSL becomes the H level, the held level of the polarity control signal POL is output from the latch 173 as the signal Cs4. As a result, the capacitor line driving circuit 171 selects the potential of the input terminal A. Here, since VMOSL is supplied to the input terminal A, the capacitor swing signal VMOS4 changes to the low capacitor potential VMOSL.

Here, the timing of the H level pulse of the capacitor control signal CSL is just after the falling edge of the scanning signal Ys4, not just after the falling edge of the scanning signal Ys3, the capacitor line driving circuits 171 of the third row and fourth row change the capacitor swing signals VMOS3 and VMOS4 to the low capacitor potential VMOSL at the timing of the H level pulse of the capacitor control signal CSL. As such, the capacitor line driving circuit 171 simultaneously performs the potential shift in the storage capacitor 119 for the scanning lines 112 belonging to each of the scanning line groups 115*a*, 115*b* . . . .

Here, in the capacitor line driving circuit 171 of the even-numbered row and the capacitor line driving circuit 171 of the odd-numbered row, the capacitor potentials supplied to the input terminals A and B are replaced with each other (see FIG. 3), but the signal POL for selecting the input terminal is polarity-inverted for every two horizontal scanning periods (2H). For example, the capacitor swing signals VMOS1 and VMOS2 supplied to the capacitor lines 113 of the first row and second row corresponding to the first scanning line group 115*a* change to the high capacitor potential VMOSH together, and the capacitor swing signals VMOS3 and VMOS4 supplied to the capacitor lines 113 of the third row and fourth row corresponding to the next scanning line group 115*b* change to the low capacitor potential VMOSL together.

The same operation is repeatedly performed in the capacitor line driving circuits 171 of the fifth row, sixth row, seventh row, . . . , and m-th row. The potential shift, which is the change of the capacitor potential, is performed for the scanning lines belonging to one scanning line group simultaneously. That is, if the scanning line group has two scanning lines, and the scanning signals Ysi and Ysi+1 supplied to the scanning lines of the i-th row and (i+1)th row belonging to the odd-numbered scanning line group 115 individually become the H level, positive polarity writing is instructed to the scanning lines 112. After the scanning signal Ysi and Ysi+1 fall to the L level, if the capacitor control signal CSL becomes the H level, the capacitor swing signals VMOSi and VMOSi+1 supplied to the capacitor line 113 of the i-th row change from the low capacitor potential VMOSL to the high capacitor potential VMOSH. On the other hand, if the scanning signal Ysi and Ysi+1 supplied to the scanning lines 112 belonging to the even-numbered scanning line group 115 individually become the H level, negative polarity writing is instructed. And then, after the scanning signals Ysi and Ysi+1 fall to the L level, if the capacitor control signal CSL becomes the H level, the capacitor swing signals VMOSi and VMOSi+1 simultaneously change from the high capacitor potential VMOSH to the low capacitor potential VMOSL.

Moreover, in the next vertical scanning period (1F), the polarity control signal POL has a polarity opposite to that in the previous vertical scanning period (1F). For this reason, if the scanning signals Ysi and Ysi+1 supplied to the scanning lines 112 constituting the odd-numbered scanning line group 115 become the H level, negative polarity writing is instructed. And then, after the scanning signal Ysi falls to the L level, if the capacitor control signal CSL becomes the H level, the capacitor swing signals VMOSi and VMOSi+1 change from the high capacitor potential VMOSH to the low capacitor potential VMOSL. On the other hand, if the scanning signals Ysi and Ysi+1 supplied to the scanning lines 112 constituting the even-numbered scanning line group 115 become the H level, positive polarity writing is instructed to the scanning lines 112. And then, after the scanning signal Ysi falls to the L level, if the capacitor control signal CSL becomes the H level, the capacitor swing signals VMOSi and VMOSi+1 supplied to the capacitor line 113 of the i-th row change from the low capacitor potential VMOSL to the high capacitor potential VMOSH.

1-3: X Side Operation

Next, among the operations of the liquid crystal display device, the X side operation will be described. Here, FIG. 6 is a timing chart illustrating the X side operation in the liquid crystal display device.

First, in FIG. 6, when paying attention to one horizontal scanning period (in FIG. 6, a period indicated by (1)) in which the scanning signal Ys1 supplied to the scanning line 112 of the first row becomes the H level, before the period, gray-scale data Data corresponding to the pixels of the first row and first column, the first row and second column, . . . , and the first row and n-th column are sequentially supplied. Among these, at the timing when gray-scale data Data corresponding to the pixel of the first row and first column is supplied, when the sampling control signal Xs1 output from the shift register 150 becomes the H level, the first sampling switch 152 corresponding to the first column is turned on, and thus gray-scale data is latched by the first latch circuit 154 corresponding to the same first column.

Next, at the timing when gray-scale data Data corresponding to the pixel of the first row and second column is supplied, when the sampling control signal Xs2 becomes the H level, the first sampling switch 152 corresponding to the second column is turned on, and thus gray-scale data is latched by the first latch circuit 154 corresponding to the same second column. Similarly, gray-scale data Data corresponding to the pixel of the first row and n-th column is latched by the first latch circuit 154 corresponding to the n-th column. Accordingly, gray-scale data Data corresponding to n pixels located at the first row are individually latched by the first latch circuits 154 corresponding to the first column, second column, . . . , and n-th column.

Next, when the latch pulse LP is output (when the logic level becomes the H level), gray-scale data Data individually latched to the first latch circuits 154 corresponding to the first column, second column, . . . , and n-th column is individually latched at once to the second latch circuits 158 corresponding to the columns when the second sampling switches 156 are turned on.

Next, gray-scale data Data individually latched by the second latch circuits 158 corresponding to the first column, second column, . . . , and n-th column is converted into the analog signals of the polarity corresponding to the logic level of the polarity writing instruction signal PS by the D/A converters 160 individually corresponding to the columns, and the converted analog signals are output as the data signals S1, S2, . . . , and Sn. At this time, when the polarity writing instruction signal PS is in the H level, the potentials of the data signals S1, S2, . . . , and Sn correspond to positive polarity writing, in detail, correspond to gray-scale data Data within a range between a potential Vwt(+) which corresponds to a positive polarity white level and a potential Vbk(+) which corresponds to a positive polarity black level.

Next, when paying attention to one horizontal scanning period (in FIG. 6, a period indicated by (2)) in which the scanning signal Ys2 supplied to the scanning line 112 of the second row becomes the H level, before the period, gray-scale data Data corresponding to the pixels of the second row and first column, the second row and second column, and the second row and n-th column is sequentially supplied, and the same operation is executed as the previous horizontal scanning period during which the scanning signal Ys1 becomes the H level. As a result, as the data signals S1, S2, . . . , and Sn, the analog signals converted to have the polarity corresponding to the logic level of the polarity writing instruction signal PS are output.

Here, in FIG. 6, in the period indicated by (1) and the period indicated by (2), since the logic level of the polarity writing instruction signal PS maintains the same H level, the data signals S1, S2, . . . , and Sn have the same output polarity.

Since the logic level of the polarity writing instruction signal PS is inverted for every two horizontal scanning periods, in one horizontal scanning period (in FIG. 6, a period indicated by (3)) in which the scanning signal Ys3 supplied to the scanning signal 112 of the third row becomes the H level, the polarity writing instruction signal PS changes to the L level. Therefore, when paying attention to the period indicated by (3), before the period, gray-scale data Data corresponding to the pixels of the second row and first column, the second row and second column, and the second row and n-th column is sequentially supplied, and the same operation as that in the period in which the scanning signal Ys2 becomes the H level is executed. However, in this case, since the logic level of the polarity writing instruction signal PS is L, as the data signals S1, S2, . . . , and Sn, analog signals converted to have a polarity opposite to those in the periods during which the scanning signals Ys1 and Ys2 become the H level are output.

After this, the same operations are repeated for each time when the scanning signals Ys4, Ys5, . . . , and Ysm become the H level. Specifically, before one horizontal scanning period when the scanning signal Ysi supplied to the scanning line 112 of the i-th row becomes the H level, gray-scale data Data corresponding to the pixels of the i-th row and first column, the i-th row and second column, . . . , and the i-th row and n-th column is sequentially supplied and latched in the first latch circuits 154 corresponding to the first row, second row, . . . , and n-th row. Subsequently, latched gray-scale data is latched to the second latch circuits 158 corresponding to the columns at once by the latch pulse LP, and converted by the D/A converters 160 corresponding to the columns into analog signals of the polarity corresponding to the logic level of the polarity writing instruction signal PS. And then, the converted analog signals are output as the data signals S1, S2, . . . , and Sn.

At this time, in the period corresponding to the scanning lines 112 belonging to the odd-numbered scanning line group 115, the polarity writing instruction signal PS becomes the H level, and thus the potentials of the data signals S1, S2, . . . , and Sn correspond to positive polarity writing. On the other hand, in the period corresponding to the scanning lines 112 belonging to the even-numbered scanning line group 115, the polarity writing instruction signal PS becomes the L level, and thus the potentials of the data signals correspond to negative polarity writing. That is, the scanning lines 112 belonging to each of the scanning line groups 115*a*, 115*b* . . . correspond to the same writing polarity and the polarity inversion does not occur.

Moreover, in the next vertical scanning period, the same operations are executed. However, within the same horizontal scanning period, since the polarity writing instruction signal PS is polarity-inverted for every one vertical scanning period, in the period corresponding to the scanning lines 112 belonging to the odd-numbered scanning line group 115, the potentials of the data signals S1, S2, . . . , and Sn correspond to negative polarity writing. On the other hand, in the period corresponding to the scanning lines 112 belonging to the even-numbered scanning line group 115, the potentials of the data signals correspond to positive polarity writing.

As a result of the above-described operations, when the scanning line 112 is in the H level (on potential of the TFT 116) and the potential of the data line 114 corresponds to positive polarity writing, after the scanning line 112 changes to the L level (off potential of the TFT 116), the capacitor line driving circuit 171 shifts the potential of the other storage capacitor electrode in the storage capacitor 119 to a high level. Further, when the potential of the data line 114 corresponds to negative polarity writing, after the scanning line 112 changes to the L level, the capacitor line driving circuit 171 shifts the potential of the other storage capacitor electrode in the storage capacitor 119 to a low level.

1-4: Operations of Storage Capacitor and Liquid Crystal Capacitor

Figure 7A:
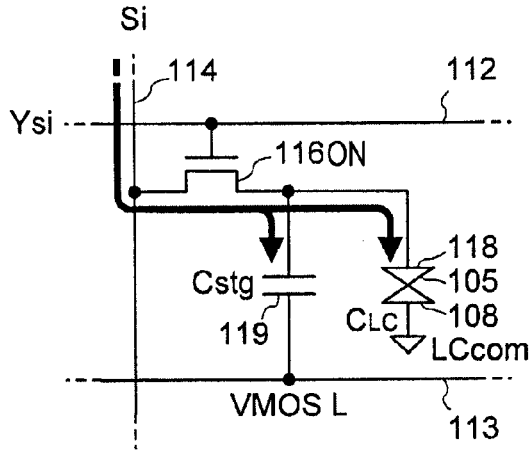
FIG. 7A is a diagram illustrating a pixel writing operation in the liquid crystal display device.
Figure 7B:
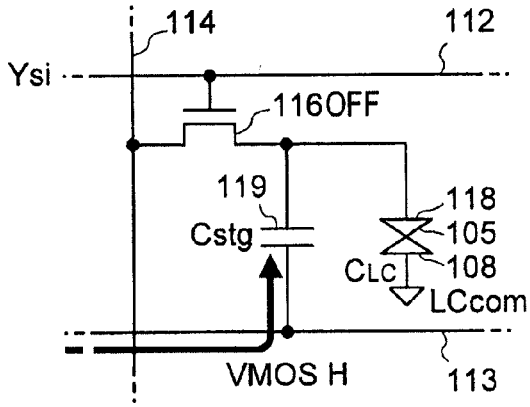
FIG. 7B is a diagram illustrating a pixel writing operation in the liquid crystal display device.
Figure 7C:
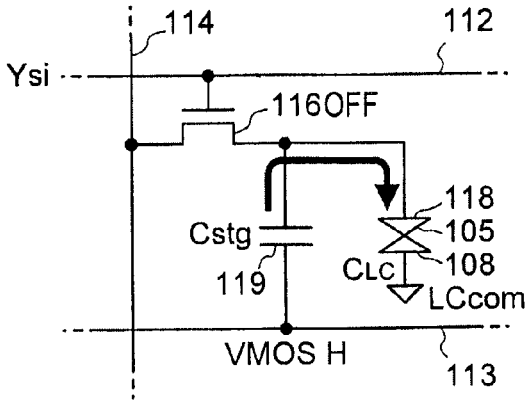
FIG. 7C is a diagram illustrating a pixel writing operation in the liquid crystal display device.

Next, the operations of the storage capacitor and the liquid crystal capacitor when the above-described X side and Y side operations are performed will be described. FIGS. 7A, 7B, and 7C are diagrams illustrating storage operations of the charge of these capacitors.

Here, for convenience of explanation, an example in which positive polarity writing is performed in the pixel 120 located at the i-th row and j-th column will be schematically described. Moreover, the low capacitor potential VMOSL the potential LCcom of the counter electrode 108 are different in practice as will be described below, but, for simplification of explanation, they are assumed to be the same here.

First, when the scanning signal Ysi becomes the H level (on potential), the TFT 116 of the pixel is turned on. Accordingly, as shown in FIG. 7A, the storage capacitor $C_{stg}$ and the liquid crystal capacitor $C_{LC}$ store the charge corresponding to the potential of the data line Sj. Given that a writing voltage charged to the storage capacitor $C_{stg}$ and the liquid crystal capacitor $C_{LC}$ is $V_0$.

Next, after the scanning signal Ysi becomes the L level (off potential), if the capacitor control signal CSL becomes the H level, the TFT 116 of the pixel is turned off. Further, in case of positive polarity writing, the capacitor swing signal VMOSi supplied to the capacitor line 113 of the i-th row changes from the low capacitor potential VMOSL to the high capacitor potential VMOSH, as described above. For this reason, as shown in FIG. 7B, a charging voltage of the storage capacitor $C_{stg}$ is increased by the change amount $V_1$. Here, $V_1$={VMOSH−VMOSL}.

However, since one end of the storage capacitor $C_{stg}$ is connected to the pixel electrode 118, as shown in FIG. 7C, the charge is transferred from the storage capacitor $C_{stg}$ whose voltage was increased to the liquid crystal capacitor $C_{LC}$. When there is no voltage difference between both capacitors, transferring the charge is completed. Thus, the charging voltages of both capacitors finally become the voltage $V_2$. The voltage $V_2$ continues to be applied to the liquid crystal capacitor $C_{LC}$ for the almost entire period when the TFT 116 is turned off. Therefore, it can be assumed that the voltage $V_2$ is effectively applied to the liquid crystal capacitor $C_{LC}$ from the time when the TFT 116 is turned on.

The voltage $V_2$ can be expressed by the following expression (1) using the storage capacitor $C_{stg}$ and the liquid crystal capacitor $C_{LC}$.

$$V_2=V_0+V_1*C_{stg}/(C_{stg}+C_{LC}) \quad (1)$$

Here, if the storage capacitor $C_{stg}$ is sufficiently larger than the liquid crystal capacitor $C_{LC}$, the expression (1) can be approximated by the following expression (2).

$$V_2=V_0+V_1 \quad (2)$$

Specifically, the final voltage applied to the liquid crystal capacitor $C_{LC}$, that is, $V_2$ is simplified to shift from the initial writing voltage $V_0$ to the high level by the increased amount $V_1$ of the capacitor swing signal VMOSi.

Moreover, here, the operations as shown in FIGS. 7B and 7C are described separately for simplification, but in practice, both operations occur concurrently. Further, here, the case where positive polarity writing is performed is described. However, in case of negative polarity writing, if the storage capacitor $C_{stg}$ is sufficiently larger than the liquid crystal capacitor $C_{LC}$, the final voltage $V_2$ applied to the liquid crystal capacitor $C_{LC}$ is to shift from the initial writing voltage $V_0$ to the low level by the change amount $V_1$ of the capacitor swing signal VMOSi.

When actually performing positive polarity writing to the pixel 120 located at the i-th row and j-th column, as described above, when the TFT 116 in the pixel is turned on, the potential of the capacitor swing signal VMOSi applied to the capacitor line 113 of the i-th row, that is, the potential of the other storage capacitor electrode of the storage capacitor $C_{stg}$ (119) in the pixel, is the low capacitor potential VMOSL.

Figure 8A:
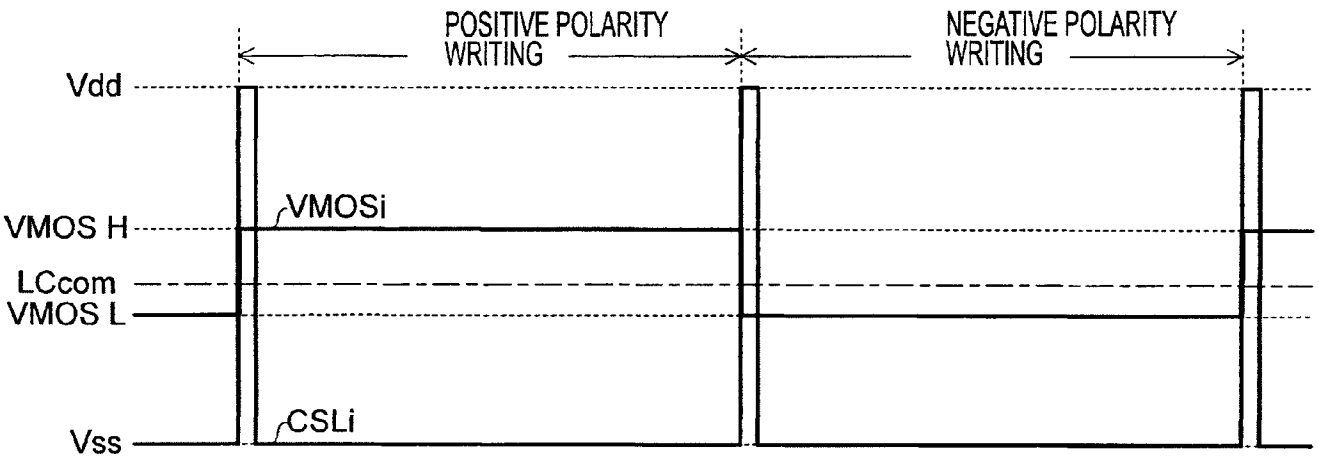
FIG. 8A is a diagram showing voltage waveforms of a scanning signal and a capacitor swing signal in the liquid crystal display device.

Further, the potential of the counter electrode 108, that is, the other end of the liquid crystal capacitor $C_{LC}$, is LCcom having a constant value (see FIG. 8A). That is, the reference potential of the charging voltage of the storage capacitor $C_{stg}$ and the reference potential of the charging voltage of the liquid crystal capacitor $C_{LC}$ is different from each other.

Figure 8B:
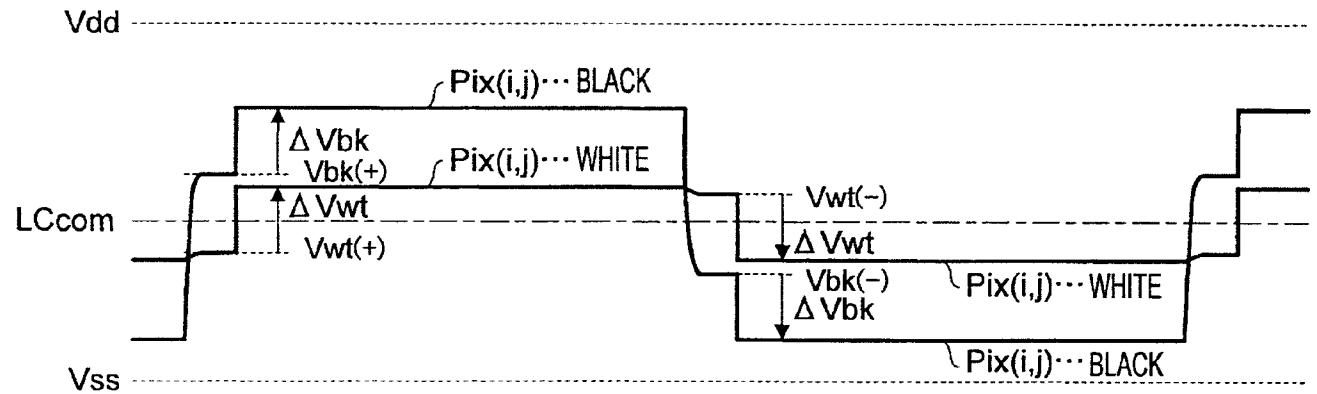
FIG. 8B is a diagram showing voltage waveforms to be applied to a pixel electrode in the liquid crystal display device.

However, as shown in FIG. 8B, the potential Pix(i,j) of the pixel electrode 118 in the pixel 120 of the i-th row and j-th column becomes, first, the potential of the data signal Sj supplied to the data line 114 of the j-th column once when the TFT 116 is turned on. Second, just after the TFT 116 is turned off and when CSLi is in the H level, in case of positive polarity writing, the capacitor swing signal VMOSi changes from the low capacitor potential VMOSL to the high capacitor potential VMOSH, and thus the potential Pix(i,j) shifts to the high level. On the other hand, in case of negative polarity writing, the capacitor swing signal VMOSi-changes from the high capacitor potential VMOSH to the low capacitor potential VMOSL, and thus the potential Pix(i,j) shifts to the low level. Further, the shift amount depends on the writing potential of the data signal Sj and the ratio of the storage capacitor $C_{stg}$ and the liquid crystal capacitor $C_{LC}$. These descriptions are the same as those in FIGS. 7A, 7B, and 7C.

Moreover, FIG. 8B shows the following four points: that is, when the TFT 116 is turned on and the potential is Vwt(+) corresponding to white level of positive polarity writing, just after the TFT 116 is turned off, the potential Pix(i,j) of the pixel electrode 118 in the pixel 120 of the i-th row and the j-th column shifts to the high level by ΔVwt depending on the voltage Vwt(+) and the ratio of storage capacitor $C_{stg}$ and the liquid crystal capacitor $C_{LC}$; when the TFT 116 is turned on and the voltage is Vbk(+) corresponding to black level of positive polarity writing, just after the TFT 116 is turned off, the potential Pix(i,j) of the pixel electrode 118 shifts to the high level by ΔVbk depending on the voltage Vbk(+) and the ratio of storage capacitor $C_{stg}$ and the liquid crystal capacitor $C_{LC}$; when the TFT 116 is turned on and the voltage is Vwt(−) corresponding to white level of negative polarity writing, just after the TFT 116 is turned off, the potential Pix(i,j) of the pixel electrode 118 shifts to the low level by ΔVwt depending on the voltage Vwt(−) and the ratio of storage capacitor $C_{stg}$ and the liquid crystal capacitor $C_{LC}$; when the TFT 116 is turned on and the voltage is Vbk(−) corresponding to black level of negative polarity writing, just after TFT 116 is off, the potential Pix(i,j) of the pixel electrode 118 shifts to the low level by ΔVbk depending on the voltage Vbk(+) and the ratio of storage capacitor $C_{stg}$ and the liquid crystal capacitor $C_{LC}$.

According to this embodiment, the data lines 114 are driven at a low voltage by increasing (or decreasing) the potentials of the data signals S1, S2, . . . , and Sn supplied from the data lines 114 to the pixel electrodes 118 by the shift amount of the capacitor swing signal VMOS. In addition, when the potential is supplied to the data lines 114, the same writing polarity is applied to a plurality of adjacent scanning lines belonging to each of the scanning line groups 115*a*, 115*b* . . . , and leaves unchanged. That is, the writing polarity of the data line 114 corresponds to adjacent scanning lines 112 belonging to each of the scanning line groups 115, 115*b* . . . , and leaves unchanged for two horizontal scanning periods. Therefore, a frequency for inversely driving the data lines can be lowered by half, as compared with inversion driving for every one horizontal scanning period, thereby realizing low power consumption.

Further, the writing polarity of the potential to the data line 114 is inverted between adjacent scanning line groups 115*a*, 115*b* . . . . Therefore, even when a variation in potential of the pixel electrode for each data line is caused by ununiformity of the liquid crystal display device 100, the polarity of the potential of the pixel electrode 118 is inverted for each of the scanning line groups 115*a*, 115*b* . . . , and thus a change in display luminance due to the variation in potential is removed. As a result, in the liquid crystal display device 100, vertical stripe-shaped noise can be prevented from being displayed corresponding to the data lines.

2: Second Embodiment

In the first embodiment described above, the writing polarity of the data line 114 corresponds to adjacent scanning lines 112 belonging to each of the scanning line groups 115*a*, 115*b* . . . and leaves unchanged for two horizontal scanning periods. That is, in the capacitor line driving circuits 171 of the first row and second row, the capacitor swing signals VMOS1 and VMOS2 shift to the same potential. Further, the capacitor swing signals VMOS1 and VMOS2 shift at the same timing. A description will be provided of a second embodiment which improves a circuit area by using these points.

Figure 9:
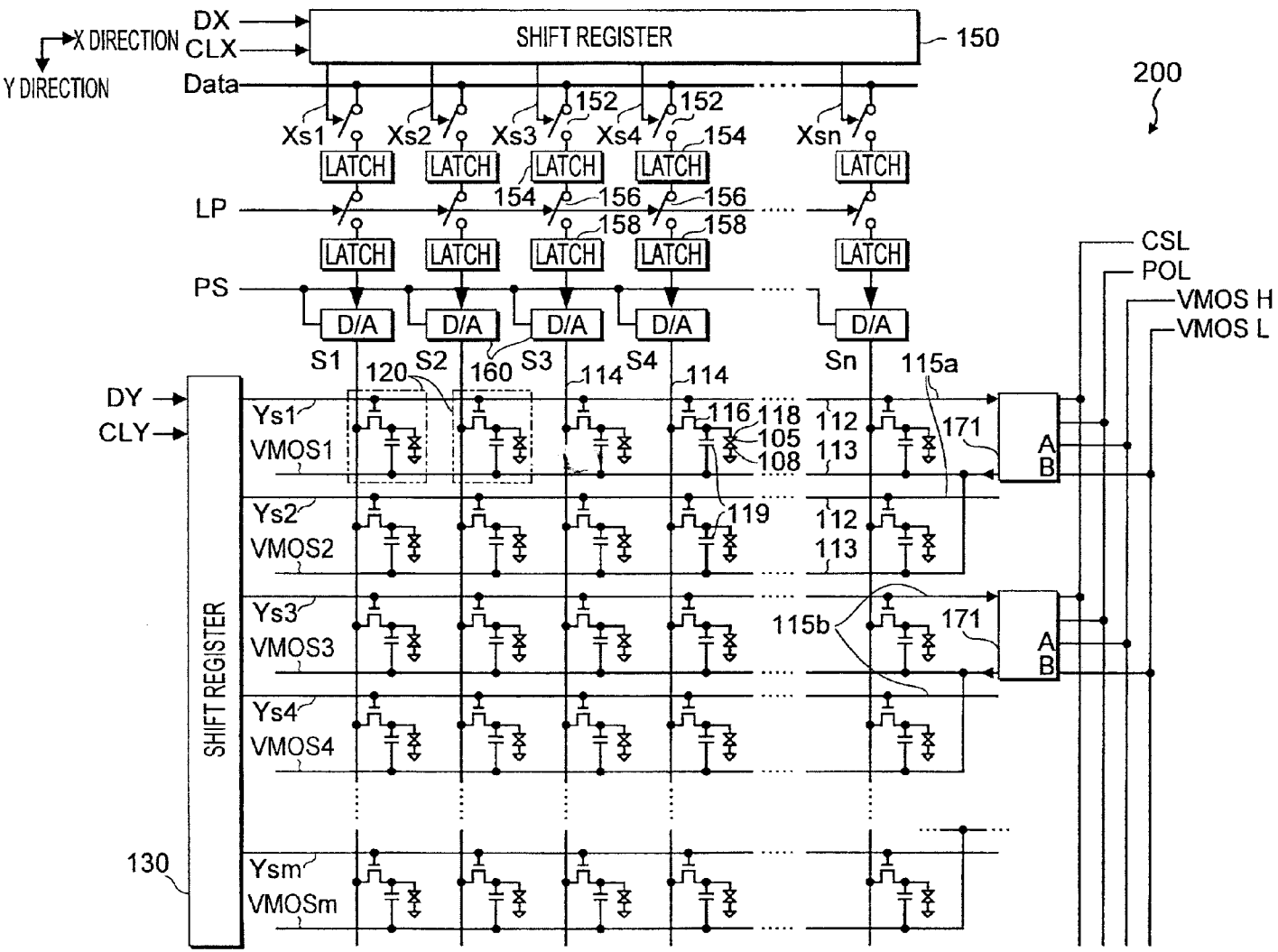
FIG. 9 is a block diagram showing an electrical configuration of a liquid crystal display device according to a second embodiment of the invention.

FIG. 9 is a block diagram showing the electrical configuration of a liquid crystal display device 200 according to the second embodiment of the invention.

In the second embodiment, one capacitor line driving circuit 171 is provided for each of capacitor line groups 115*a*, 115*b* . . . constituting the other storage capacitor electrodes of the storage capacitors. That is, the second embodiment is different from the first embodiment in that one capacitor line driving circuit 171 drives a plurality of capacitor lines 113 belonging to the capacitor line group 115*a*. Other parts of the liquid crystal display device according to the second embodiment are the same as those in the first embodiment shown in FIGS. 1 to 3, and the descriptions thereof will be omitted.

As shown in FIG. 9, in the second embodiment, adjacent capacitor lines 113 belonging to each of the capacitor line groups 115*a*, 115*b* . . . correspond to adjacent scanning lines 112 belonging to each of the scanning line groups 115*a*, 115*b* . . . . Since the capacitor line driving circuit 171 shifts the capacitor swing signals VMOS1 and VMOS2 at the same timing, one capacitor line driving circuit 171 is used for each of the capacitor line groups 115*a*, 115*b* . . . , and thus the number of capacitor line driving circuits 171 is reduced by half. Accordingly, the area of the capacitor line driving circuit 171 can be reduced, and the area of the entire circuit and power consumption can be reduced.

3: Third Embodiment

In the first embodiment described above, at the timing when the scanning lines sequentially become the on potential, the data lines turn to the potential corresponding to the writing polarity, whereas the potential shift of the other end in the storage capacitor is performed among the scanning lines belonging to one scanning line group. For this reason, the time required from the arrival of the data line to the predetermined potential until the potential shift of the other storage capacitor electrode in the storage capacitor starts differs among the scanning lines belonging to one scanning line group. A description will be provided for a third embodiment which removes a possibility that the electrode voltage as the shift result of the potential differs for each scanning line due to this difference.

Figure 10:
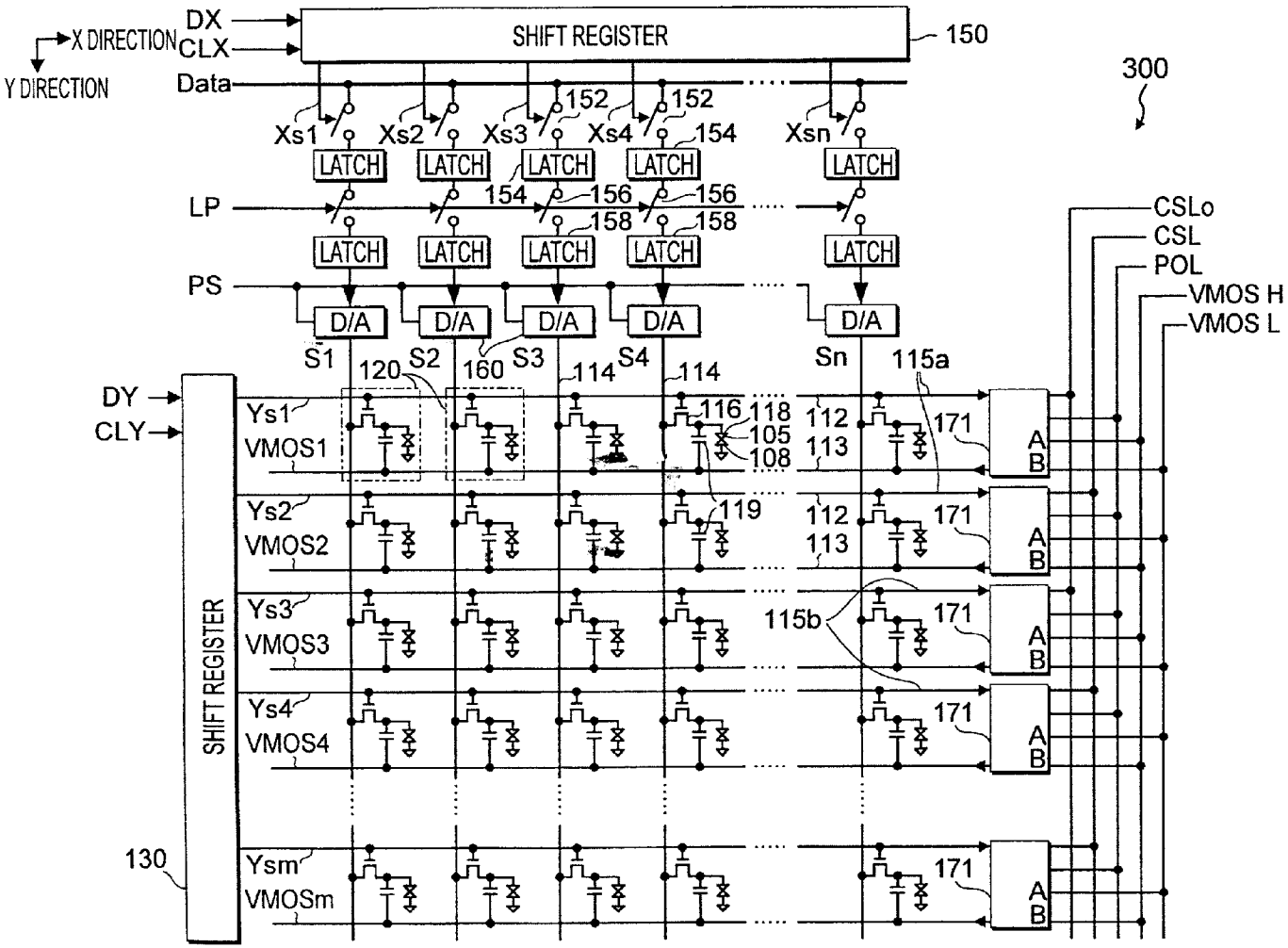
FIG. 10 is a block diagram showing an electrical configuration of a liquid crystal display device according to a third embodiment of the invention.

FIG. 10 is a block diagram showing the electrical configuration of a liquid crystal display device according to the third embodiment of the invention.

As shown in FIG. 10, of the capacitor line driving circuits 171 individually provided for rows, the capacitor control signal $CSL_O$ is supplied to the odd-numbered capacitor line driving circuit 171, whereas the capacitor control signal CSL is supplied to the even-numbered capacitor line driving circuit 171. Here, as shown in FIG. 11, the capacitor control signal CSL is the same signal as that in the first embodiment, and the capacitor control signal $CSL_O$ is a signal having a waveform advanced by one horizontal scanning period with respect to the capacitor control signal CSL.

Moreover, other parts of the liquid crystal display device according to the third embodiment are the same as those shown in FIGS. 1 to 3, and the descriptions thereof will be omitted.

Figure 11:
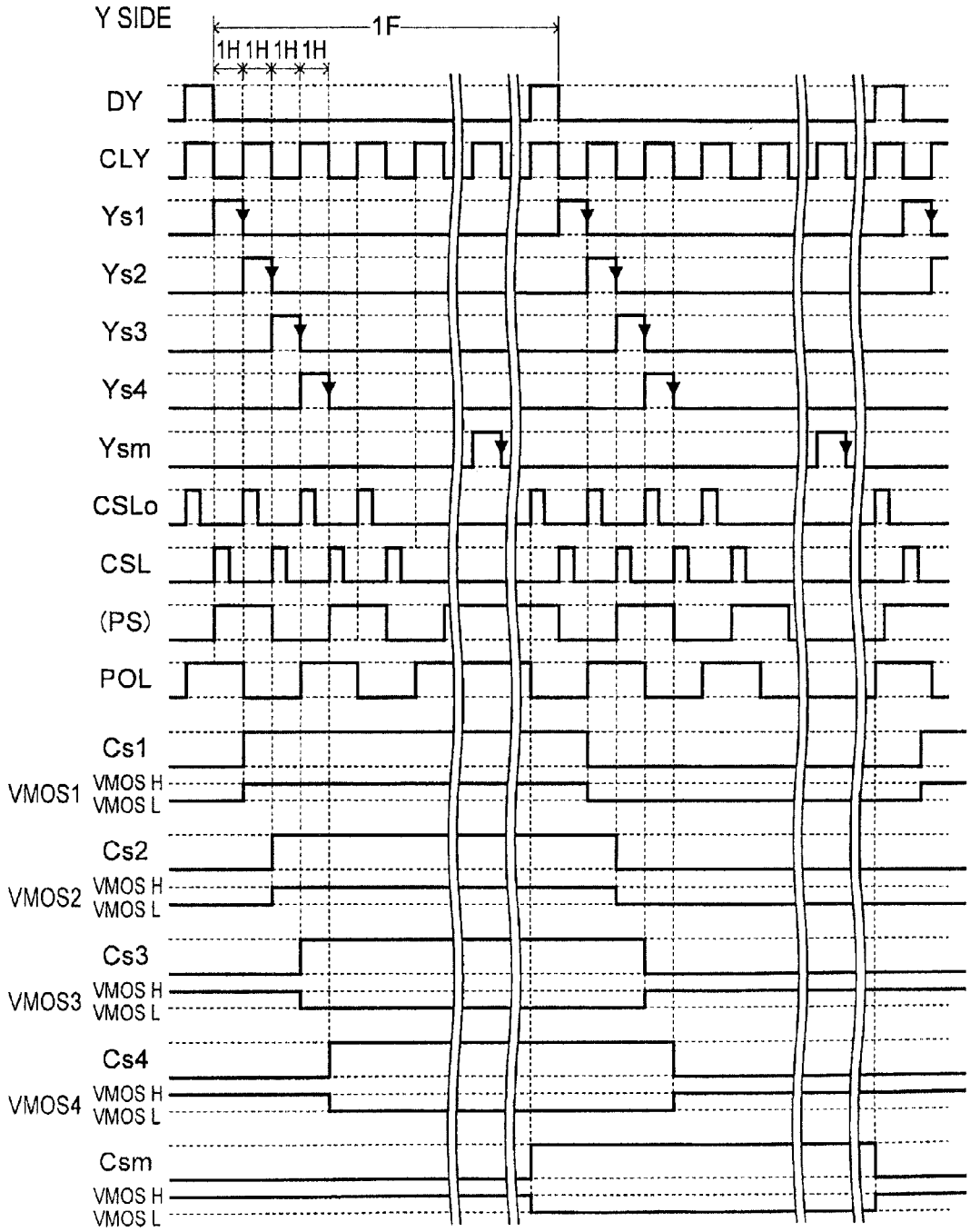
FIG. 11 is a timing chart illustrating a Y side operation in the liquid crystal display device.

FIG. 11 is a timing chart illustrating the Y side operation in the liquid crystal display device according to the third embodiment.

Here, in the initial one vertical scanning period (1F), when the scanning signal Ys1 becomes the H level, the polarity control signal POL is in the H level, and the latch 172 of the capacitor line driving circuit 171 corresponding to the first row holds that logic level. After the scanning signal Ys1 falls and the TFT 116 of the pixel 120 located at the first row is turned off, if the capacitor control signal $CSL_O$ becomes the H level, the held level of the polarity control signal POL is output from the latch 173 as the signal Cs1.

Next, when the scanning signal Ys2 becomes the H level, the polarity writing instruction signal PS maintains the H level. At this time, the polarity control signal POL changes to the L level, the latch 172 of the capacitor line driving circuit 171 corresponding to the second row holds that logic level. After the scanning signal Ys2 falls and the TFT 116 of the pixel 120 located at the second row is turned off, if the capacitor control signal CSL becomes the H level, the held level of the polarity control signal POL is output from the latch 173 as the signal Cs2.

Here, the H level pulse of the capacitor control signal $CSL_O$ is supplied once for two horizontal scanning periods (2H), and the timing is just after the fall of the scanning signal Ys1. Further, the H level pulse of the capacitor control signal CSL is also supplied once for two horizontal scanning periods (2H), and the timing is just after the fall of the scanning signal Ys2.

4: Summary of Liquid Crystal Display Device

As such, in this embodiment, at the timing when the scanning lines sequentially become the on potential, the data lines turn to the potential corresponding to the writing polarity, and the potential shift of the other end in the storage capacitor is performed just after the corresponding scanning line becomes the off potential. For this reason, the time required from the arrival of the data line to the predetermined potential until the potential shift of the other storage capacitor electrode in the storage capacitor starts is the same over all scanning lines. Therefore, the voltage unbalance of the pixel electrode due to the difference in voltage of the shift result of the potential for the scanning lines can be reduced.

Moreover, the description has been provided of the scanning lines 112 which are divided into the scanning line groups 115 (115*a*, 115*b*) each having two adjacent scanning lines 112. However, the invention is not limited to this configuration. For example, the scanning line group may have three or more adjacent scanning lines.

Figure 12:
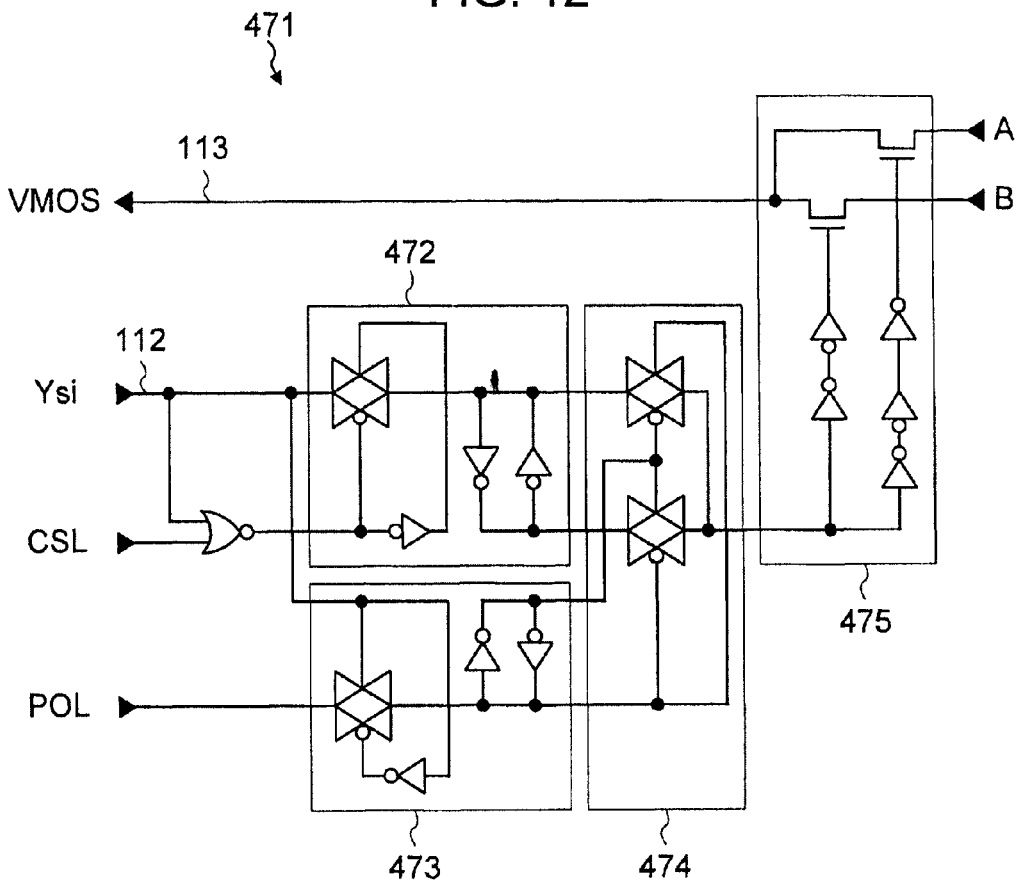
FIG. 12 is a circuit diagram showing a modification of a capacitor line driving circuit of the liquid crystal display device.

Further, a driving circuit of the invention is not limited to the above-described circuit, but various configurations can be adopted. For example, as a capacitor line driving circuit according to an additional embodiment, as shown in FIG. 12, a driving circuit may have a latch 472 which latches the logic level of the scanning line Ysi when the logic level of the scanning signal Ysi or the capacitor control signal CSL is in the H level, a latch 473 which holds the logic level of the polarity control signal POL when the logic level of the scanning signal Ysi is in the H level, an inversion circuit 474 which inverts the level held by the latch 472 according to the level held by the latch 473 and outputs the inverted level as the selection control signal Cs, and a selector 475 which selects one of the potential of the input terminal A and the potential of the input terminal B according to the level of the selection control signal Cs and supplies the selected signal to the capacitor line 113 as the capacitor swing signal VMOS.

Further, in the first embodiment described above, the potentials input to the input terminals A and B in the capacitor line driving circuit 171 are replaced with each other at the odd-numbered rows and the even-numbered rows. However, the invention is not limited to this configuration. For example, the potentials may be replaced with each other on the basis of the scanning line group corresponding to two rows. In this case, the inversion of the data line can be performed for every two horizontal scanning periods by replacing the potentials input to the input terminals A and B with each other, without inverting the polarity control signal POL for every two horizontal scanning periods. On the other hand, in the configuration in which the potentials input to the input terminals A and B are replaced with each other at the odd-numbered rows and the even-numbered rows, according to definition of a display image, it is easy to maintain compatibility with a driving circuit which performs the inversion of the data line for every one horizontal scanning period.

That is, according to the configuration in which the potentials input to the input terminals A and B are replaced with each other at the odd-numbered rows and the even-numbered rows, only by supplying the H level pulse of the capacitor control signal CSL once for every one horizontal scanning period and causing the polarity control signal POL and the polarity writing instruction signal PS to be inverted for every one horizontal scanning period, the inversion of the data line can be performed for every one horizontal scanning period. Accordingly, when the variation in potential of the pixel electrode for each data line due to manufacturing ununiformity of the liquid crystal display device is negligible, the luminance change caused by the variation can be removed and reduced for every one adjacent scanning line, thereby performing the change to inversion driving for every one horizontal scanning period.

Moreover, in the above-described first, second, and third embodiments, four-bit gray-scale data Data is used so as to perform 16 gray-scale display, but the invention is not limited to the embodiments. For example, the number of bits may be increased so as to perform multiple gray-scale levels or one dot may be formed of three pixels of R (red), G (green), and B (blue) so as to perform color display. Further, in the embodiments, a description is provided based on a normally white mode in which the maximum transmittance appears when no voltage is applied to the liquid crystal capacitor. However, it may be based on a normally black mode in which the minimum transmittance appears when no voltage is applied to the liquid crystal capacitor.

In addition, in the embodiments, a glass substrate is used for the element substrate 101. However, the element substrate 101 may be formed by applying an SOI (Silicon On Insulator) technology to form a silicon monocrystal film on an insulated substrate made of materials, such as sapphire, quartz, and glass, and to create various elements there. Further, for the element substrate 101, a silicon substrate can be used, and various elements can be created there. In this case, as a switching element, high-speed field effect transistors can be used, thereby making it easy to achieve higher operations than the TFT. However, when the element substrate 101 does not have transparency, it is necessary to use a reflection type by forming the pixel electrode 118 using aluminum or forming a separate reflection layer. Further, in the embodiments, as a switching element interposed between the data line 114 and the pixel electrode 118, a three-terminal element, such as a TFT, is used, but a two-terminal element, such as a TFD (Thin Film Diode), can also be used.

In addition, in the above-described embodiment, TN liquid crystal is used, but bistable liquid crystal having memory capability such as BTN (Bi-stable Twisted Nematic) type and ferroelectric type, and polymer dispersed type, and GH (guest host) type liquid crystal in which dye molecules and crystal molecules are arranged in parallel by dissolving a dye (guest) having anisotropy in absorption of visible light in the molecular longitudinal direction and latitudinal direction into liquid crystal (host) whose molecules are aligned constantly. Further, liquid crystal can be arranged in vertical alignment (homoetropic alignment) in which liquid crystal molecules are aligned perpendicularly to the substrates when no voltage is applied, whereas liquid crystal molecules are aligned horizontally to the substrates when voltage is applied, or it can be arranged in parallel (horizontal) alignment (homogeneous alignment) in which liquid crystal molecules are aligned horizontally to the substrates when no voltage is applied, whereas liquid crystal molecules are aligned perpendicularly to the substrates when voltage is applied. As such, in the invention, various types of liquid crystal and alignment methods can be applied.

5: Electronic Apparatus

Next, an electronic apparatus to which the liquid crystal display device 100 according to the above-described embodiment is applied will be described.

Figure 13:
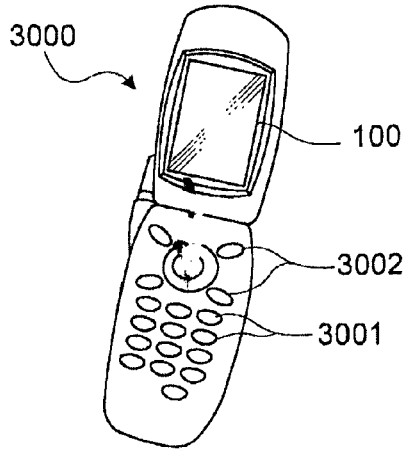
FIG. 13 is a perspective view showing a configuration of a cellular phone as an example of an electronic apparatus to which the liquid crystal display device according to the embodiment is applied.

FIG. 13 shows the configuration of a cellular phone to which the liquid crystal display device 100 is applied. A cellular phone 300 has a plurality of operating buttons 3001 and scroll buttons 3002, and the liquid crystal display device 100 serving as a display unit. By operating the scroll buttons 3002, a screen displayed onto the liquid crystal display device 100 is scrolled.

Moreover, as an electronic apparatus, in addition to what described with reference to FIG. 13, a projector, a personal computer, a liquid crystal television, a viewfinder-type or monitor-direct-view-type video tape recorder, a car navigation device, a pager, an electronic organizer, a word processor, a workstation, a video phone, a POS terminal, a digital still camera, an apparatus having a touch panel, and the like can be exemplified. Of course, a liquid crystal display device according to the embodiments, or the application or modification can be applied to various electronic apparatuses.

The entire disclosure of Japanese Patent Application Nos: 2005-110554, filed Apr. 7, 2005 and 2006-68765, filed Mar. 14, 2006 are expressly incorporated by reference herein.

What is claimed is:

1. A driving circuit for a liquid crystal display device, which has adjacent scanning line groups each having a plurality of scanning lines, data lines, liquid crystal capacitors correspondingly provided intersections between the plurality of scanning lines and the data lines with liquid crystal interposed between a counter electrode and pixel electrodes, switching elements interposed between the data lines and the pixel electrodes, the switching elements being turned on when an on potential is applied to the scanning lines and being turned off when an off potential is applied to the scanning lines, and storage capacitors each having one storage capacitor electrode connected to the corresponding pixel electrode and the other storage capacitor electrode disposed to face one storage capacitor electrode, the driving circuit for a liquid crystal display device comprising:

a scanning line driving circuit that applies the on potential to the plurality of scanning lines so as to sequentially drive the plurality of scanning lines;

a data line driving circuit that, when the on potential is applied to each of the plurality of scanning lines by the scanning line driving circuit, turns the potentials of the data lines to a potential difference according to a density on the basis of a potential of the counter electrode and the potentials corresponding to the same writing polarity among the scanning lines belonging to each of the groups of scanning lines; and a storage capacitor driving circuit which, when the on potential is applied to the scanning lines in the scanning line groups and the potential of the data line corresponds to positive polarity writing, simultaneously provides a first potential, which shifts a potential of the other storage capacitor electrode in each of the storage capacitors to a high level after the off potential is applied to all of the scanning lines in one of the scanning line groups, to the other storage capacitor electrode corresponding to all of the scanning lines in the one of the scanning line groups, and, when the on potential is applied to the scanning lines and the potential of the data line corresponds to negative polarity writing, simultaneously provides the second potential, which shifts the potential of the other storage capacitor electrode in each of the storage capacitors to a low level after the off potential is applied to all of the scanning lines in the one of the scanning line groups, to the other storage capacitor electrode which corresponds to all of the scanning lines in the one of the scanning line groups.

2. The driving circuit for a liquid crystal display device according to claim 1, wherein the number of adjacent scanning lines belonging to each of the scanning line groups is two, and the data line driving circuit inverts the writing polarities of the data lines for every two horizontal scanning periods.

3. The driving circuit for a liquid crystal display device according to claim 1, wherein the data line driving circuit turns the potential of the data line to a potential corresponding to a different writing polarity between adjacent scanning line groups.

4. A liquid crystal display device comprising the driving circuit for a liquid crystal display device according to claim 1.

5. An electronic apparatus comprising the liquid crystal display device according to claim 4.

6. A method of driving a liquid crystal display device, which has adjacent scanning line groups each having a plurality of scanning lines, data lines, liquid crystal capacitors correspondingly provided intersections between the plurality of scanning lines and the data lines with liquid crystal interposed between a counter electrode and pixel electrodes, switching elements interposed between the data lines and the pixel electrodes, the switching elements being turned on when an on potential is applied to the scanning lines and being turned off when an off potential is applied to the scanning lines, and storage capacitors each having one storage capacitor electrode connected to the corresponding pixel electrode and the other storage capacitor electrode disposed to face one storage capacitor electrode, the method comprising:

sequentially applying the on potential to the plurality of scanning lines;

when the on potential is applied to each of the plurality of scanning lines, turning the potentials of the data lines to a potential difference according to a density on the basis of a potential of the counter electrode and the potentials corresponding to the same writing polarity among the scanning lines belonging to each of the scanning line groups; and when the on potential is applied to the scanning lines in the scanning line groups and the potential of the data line corresponds to positive polarity writing, simultaneously shifting a potential of the other storage capacitor electrode corresponding to all of the scanning lines in one of the scanning line groups in each of the storage capacitors to a high level after the off potential is applied to all of the scanning lines in the one of the scanning line groups, and, when the on potential is applied to the scanning lines in the one of the scanning line groups and the potential of the data line corresponds to negative polarity writing, simultaneously shifting the potential of the other storage capacitor electrode which corresponds to all of the scanning lines in the one of the scanning line groups in each of the storage capacitors to a low level after the off potential is applied to all of the scanning lines in the one of the scanning line groups.

* * * * *